US006011193A

United States Patent [19]

Myler et al.

[11] Patent Number: 6,011,193

[45] Date of Patent: Jan. 4, 2000

[54] MUNITIONS TREATMENT BY ACID DIGESTION

[75] Inventors: Craig A. Myler, Forrest Hills; Martin E. Toomajian, Havre de Grace, both of Md.; Monte R. Elmore, West Richland, Wash.; Evan O. Jones; Alan H. Zacher, both of Richland, Wash.

[73] Assignee: Battelle Memorial Institute, Richland, Wash.

[21] Appl. No.: 08/879,539

[22] Filed: Jun. 20, 1997

[51] Int. Cl.[7] ..... A62D 3/00

[52] U.S. Cl. ..... 588/200; 588/202; 588/203

[58] Field of Search ..... 588/200, 202, 588/203; 205/688, 702, 717, 771

[56] References Cited

U.S. PATENT DOCUMENTS

| | | | |
|---|---|---|---|
| 3,108,918 | 10/1963 | Plumley | 156/18 |
| 4,284,514 | 8/1981 | Wright | 210/721 |
| 5,430,228 | 7/1995 | Ciambron et al. | 588/200 |
| 5,516,971 | 5/1996 | Hurley | 588/203 |
| 5,574,203 | 11/1996 | Noel et al. | 588/203 |
| 5,714,128 | 2/1998 | Ritter | 422/211 |
| 5,781,868 | 7/1998 | Miller et al. | 588/200 |
| 5,810,995 | 9/1998 | Soilleux et al. | 205/688 |

FOREIGN PATENT DOCUMENTS

| | | | |
|---|---|---|---|
| 0013822 A2 | 8/1980 | European Pat. Off. | A62D 3/00 |
| 13822 | 8/1980 | European Pat. Off. | 210/721 |
| 828449 | 5/1938 | France | 588/202 |
| 2704640 | 11/1994 | France | 588/203 |
| 2734048 | 11/1996 | France | 588/202 |
| 362726 | 5/1921 | Germany . | |
| 342265 | 10/1921 | Germany | 588/202 |
| 362726 | 10/1922 | Germany | 588/202 |
| 342265 | 1/1929 | Germany . | |
| 41 23 225 C1 | 11/1992 | Germany | F42D 5/04 |
| 4123225 | 11/1992 | Germany | 588/202 |
| 2291433 | 1/1996 | United Kingdom | 205/688 |
| 9621838 | 7/1996 | WIPO | 588/202 |
| PCT/US95/16644 | 7/1996 | WIPO . | |
| 9634662 | 11/1996 | WIPO | 588/202 |
| PCT/EP95/01710 | 11/1996 | WIPO | A62D 3/00 |

*Primary Examiner*—Gary P. Straub
*Assistant Examiner*—Melanie C. Wong
*Attorney, Agent, or Firm*—Stephen R. May; Paul W. Zimmerman

[57] ABSTRACT

A treatment method for containers of hazardous materials, including chemical and conventional weapons, is described. The method is applicable to munitions containing explosives and chemical warfare agents, and to training or test rounds. The containers are subjected to a highly corrosive fluid which dissolves all or part of the container and renders the containers useless as munitions. The highly corrosive fluid may render the hazardous material non-hazardous. The result of the treatment is a liquor which can undergo further treatment for recovery or disposal.

9 Claims, 1 Drawing Sheet

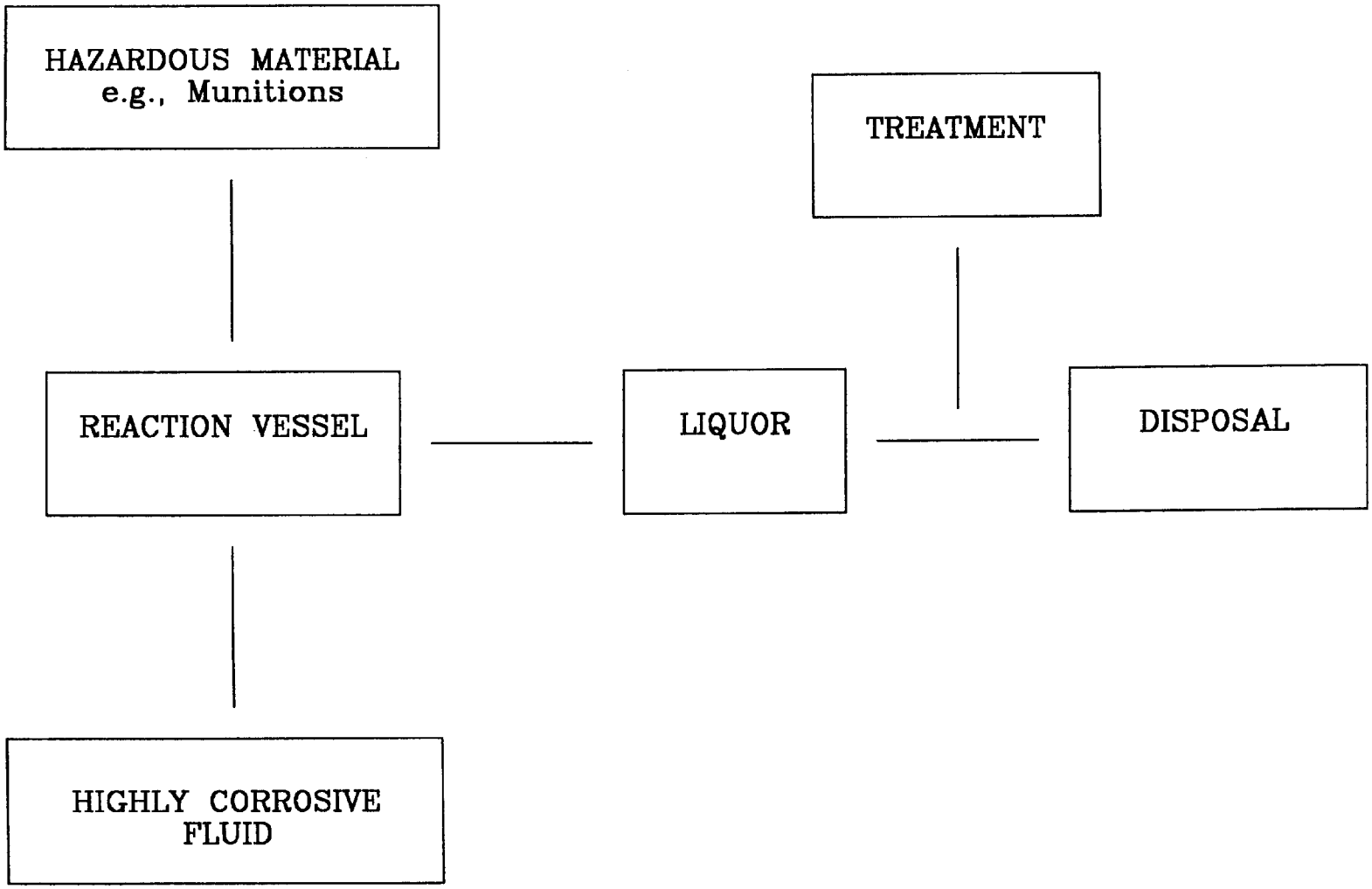
HAZARDOUS MATERIAL
e.g., Munitions
REACTION VESSEL
HIGHLY CORROSIVE
FLUID
LIQUOR
TREATMENT
DISPOSAL

MUNITIONS TREATMENT BY ACID DIGESTION

BACKGROUND OF THE INVENTION

With demilitarization worldwide, explosive ordnance disposal (EOD) is becoming an ever more-important technology as nations struggle to deal with stockpiles of explosive devices. The most commonly employed method of EOD heretofore has been open burning and destruction of such devices in, for example, open pits in remote areas. However, the potential for unintended consequences especially when dealing with unstable devices, has led to consideration of alternative methods of EOD.

Recovery of the components, such as propellants and warheads, from such devices has not been a priority, and is only attempted when the manufacturing cost or strategic importance of a particular ingredient is sufficiently high to justify the added recovery expense. However, a process enabling recovery and reuse of these components would increase the cost-effectiveness of such processes.

In addition to the inherent danger involved in EOD, emerging pollution control regulations place severe limitations on the open burning and open detonation (OB/OD) of materials classified as hazardous wastes. Methods of disposal which do not involve detonation or atmospheric pollution are therefore needed. To that end, water-jet cutting followed by oxidizer solvation and reclamation using traditional solvent extraction processes have been proposed, however such technologies have not yet proved practicable.

The method disclosed in U.S. Pat. No. 4,854,982 involves the comminution and removal of propellant ingredients from rocket motors, and extraction/recovery of ammonium perchlorate oxidizer or other soluble ingredients with high pressure anhydrous liquid ammonia. Internal gas pressure within the rocket motor must be greater than that of the vapor pressure of ammonia at the demilitarization temperature to maintain ammonia in liquid state throughout the propellant removal process. Likewise, in U.S. Pat. No. 4,909,868, an inert solvent, such as near-critical or supercritical $CO_2$, is used to extract plasticizers and stabilizers from propellant, explosive or pyrotechnic compositions.

Finally, in U.S. Pat. No. 5,284,995, a process is disclosed whereby nitramine oxidizers from solid propellant is extracted and recovered using liquid ammonia. The propellant is cut into small pieces, oxidizers are liquified with solvent ammonia, insoluble binders are separated and the remainder recompressed to liquify the liquified gas solvent ammonia for reuse.

While the forgoing patents have addressed one problem encountered with the disposal of munitions (treatment of the propellant/explosive materials), heretofore a major problem remained unsolved. That is, how does one actually gain access to the interior of the metal-clad ordnance to treat the hazardous materials therein? Physically cutting the casing, or mechanically boring holes therein carries inherent risks of accidental ignition, detonation or uncontrolled release of chemicals, and it is difficult to thereafter demonstrate complete removal of the hazardous components therein. This issue has been partially addressed in the past with the concept of "acid trepanning"—gaining access to the interior of the casing by boring holes in the casing with an acid composition. Acid trepanning has been considered in the neutralization of various explosives, including trinitrotoluene (TNT), dynamite (nitroglycerine), pentaerythritol tetranitrate (PETN), cyclotrimethylenetrinitramine (RDX), and ammonium nitrate (AN)—however the interaction between the acid and explosive has been of considerable concern.

Mixtures of pure concentrated acid and explosives can be relatively safe, but the presence of certain dissolved species may create problems. For steel-encased ordnance, aqueous nitric acid solutions with hydrogen peroxide has been used in acid trepanning, while for aluminum casing the use of a concentrated hydrochloric acid solution with at least 1M hydrated cupric chloride has been reported.

Such processes have not been demonstrated with chemical weapon stockpiles subject to demilitarization. The only presently practiced process for such weapons is incineration. However, the facilities necessary to incinerate relatively small quantities of chemical weapons at remote sites makes the construction of such facilities uneconomical. Incineration is subject to potential significant release of chemical agents as vapors. For example, incineration of chemical weapons at Johnson Atoll Chemical Agent Disposal System (JACADS) resulted in three atmospheric releases and at Toelle Chemical Agent Disposal Facility (TOCDF) a single release of chemical agents.

In addition to disposal of munitions actually having chemical or other hazardous materials therein, the disposal of a large number of "test rounds" is a matter of increasing concern. Such rounds are typically filled with a liquid (such as ethylene glycol) simulating the liquid chemical agent. Such rounds are considered by some to be hazardous in their own right, because they are susceptible to being refilled and reused. Additionally, when stored with munitions actually containing chemical agents, it is often impossible to distinguish the test rounds from the live rounds, and it is easier to treat the test rounds as hazardous rather than attempt a determination of their actual state of readiness.

The process of the present invention (hereinafter referred to as the MTAD process) has three distinct advantages: 1) minimal mechanical shock to the device, 2) capability of remote operation, and 3) elimination of the container to an inoperative condition.

Therefore, it is an object of the present invention to provide a comprehensive, safe and cost effective method of treating munitions using acid digestion. The process will provide an effective alternative to conventional methods of rendering such ordnance safe and inoperative within the parameters of current international demilitarization treaties.

BRIEF SUMMARY OF THE INVENTION

In its broadest embodiment, the present invention comprises a process for treating containers of hazardous materials (such as assembled munitions containing chemicals used in chemical warfare) to render the containers susceptible to disposal, using highly corrosive fluids, including the steps of:

digesting the casing containing the hazardous material in a highly corrosive fluid to produce a liquor;

treating the liquor to render it susceptible to recovery or disposal; and recovering or disposing of the treated liquor.

In the context of an explosive projectile, missile or the like, the process set forth above may require the removal of explosive or trigger devices, or exterior coatings from the weapon. For example, the trigger devices found in many projectiles may be easily removed and treated for disposal. Care must be taken to ensure that the digestion of the casing in the highly corrosive fluid does not produce by-products which may react with the explosive components. In such cases, the explosives must be removed prior to processing of the munition. In addition, the highly corrosive fluid may contain additives to minimize emissions, enhance dissolution, or enhance recovery and disposal of the byproducts. The process may be practiced in the environment of a fixed installation, or as a transportable or mobile system.

BRIEF DESCRIPTION OF THE SEVERAL VIEWS OF THE DRAWINGS

The FIGURE is a schematic representation of the process of the present invention.

DETAILED DESCRIPTION OF THE INVENTION

As illustrated in the FIGURE the present invention, in its broadest embodiment, comprises a method having the following steps:

a. placing the container(s) of hazardous material in a reaction vessel, dissolving the casing in a highly corrosive fluid;

b. producing a liquor containing the highly corrosive fluid, the dissolved casing, and any hazardous materials contained in the casing, in either a dissolved or undissolved state;

c. treating the liquor so as to place the liquor in a condition for recovery or disposal; and d. recovering or disposing of the liquor.

The foregoing steps are subject to conventional process variables depending upon the peculiarities of the container and/or hazardous material.

While the process of the present invention may be useful for the dissolution of a broad range of containers with hazardous materials therein, it is especially adapted to the digestion of munitions containing chemical weapon components. The munitions are typically projectile shells having a metallic outer casing, and containing a fuse, explosive and a chemical agent. Alternatively, the munitions may be of different configurations, such as missiles or rockets. Unless otherwise set forth, as used herein, the word "munitions" will refer to simulated (test) and actual weapons, since it may not be possible to determine the actual form of the munition from a physical observation.

Accordingly, it is contemplated that the primary use environment of the present invention will be the treatment of munitions having metallic casings to render them unusable and susceptible to destruction. For example, brass, carbon or mild steel projectiles can be treated using acidic fluids, while aluminum casings may be treated with either acid or alkaline fluids. The process of the present invention may be used to completely dissolve the munition body, or it may be used to partially dissolve the casing so as to render the shell or projectile militarily unusable. If the munition is not totally dissolved, the remaining metals may be recovered and recycled. During the process of the present invention, products within the munition may be recovered for reuse. Explosives such as RDX are insoluble in many acids and can be recovered from the liquor by filtration.

It is to be understood that reverse assembly to remove the explosive trigger (or burster) may be desirable or necessary if in fact the explosive material is at risk of detonation from exposure to either the concentrated acid solution or the reaction products of the acid and metallic casing. Whether or not this step is practiced will depend upon the specific chemistry of the particular process practiced.

The method of the present invention may be utilized with chemical or conventional weapons classified as explosively or non-explosively configured, or with test or simulated rounds of these weapons.

In particular the invention is particularly adapted, but not limited to, use with metallic-encased munitions such as projectiles, bombs, cartridges, and rockets, and to metallic bulk containers used to store or transport the chemicals utilized in such munitions.

It will be apparent to those skilled in this art that the metallic material used in construction of the ordnance will determine the type of highly corrosive fluid used, the concentration of the fluid, the rate of digestion, and the like.

Applicant has determined that a concentrated nitric acid solution is the preferred acid for digestion of steel munitions. The initial acid concentration may range from three to eight molar (3M to 8M) depending on the desired rate of dissolution. While generally not optimal, under other circumstances the concentrated acid may be selected from the group of concentrated hydrochloric acid, sulfuric acid, hydrofluoric acid, and the like, including mixtures of these acids.

The process of the present invention is preferably carried out in a reaction vessel impervious to the corrosive effects of the corrosive fluid. In order to increase the rate of digestion of the metallic casing, the reaction vessel may be heated to a temperature of up to or exceeding about 50° C. However, it is to be understood that in the preferred embodiment, the process is exothermic, and the digestion rate of the munitions is sufficient at ambient temperatures so that application of external heat may be unnecessary.

While complete immersion of the article to be dissolved in the corrosive fluid is one method of practicing the present invention, Applicants have found that in certain cases placing the article in the reaction vessel and then coating the article with a spray of the corrosive fluid, or flowing a stream of the corrosive fluid onto the article, produces a faster corrosion rate.

Sparging the reaction vessel with ambient air or oxygen will, in some cases, increase the conversion of ferrous ions to ferric ions, thus increasing the rate of digestion of the metallic casing. In addition, impressing an electrical current into the reaction vessel will induce anodic dissolution of the metallic casing, also increasing the digestion rate.

Dissolution of the chemical agents in the ordnance will occur and chemical reactions may take place depending on the fluids selected. These reactions may detoxify the chemical agents allowing for their safe disposal. Chemical agents include mustard agents (HD, HT, HN, HL, CX, PD, ED, MD), nerve agents (tabun, sarin, soman, VX, GF), blood agents (AC, CK, SA), choking agents (CG, DP), vomiting agents (DA, DM, DC), and incapacitating agents (BZ). Products from the chemical reactions will vary depending on the fluid used to dissolve the munition casing. For example, mustards will form sulfoxides and sulfolone if treated with nitric acid or thiodyglycol if treated with caustic.

It is expected that in certain cases, organic chemical explosives will be insoluble in the acid and therefore not dissolved in the liquor. In such cases, the organic constituents can be filtered out and recovered for disposal separately, or for reuse. Following treatment, various disposal methods are available including discharge to solidification/stabilization, hydrothermal oxidation, or incineration.

One of the beneficial aspects of the present invention is that after the casing has been completely breached, the dissolving liquid will enter the container, flush out the components therein, and "cleanse" the inner surface of the container. For example, after concentrated nitric acid digests a point on the outer shell casing of a projectile containing chemical weapon materials, the acid will infiltrate the inner casing, either dissolving or flushing the contents therein into the surrounding acid bath. After flushing all the internal components therefrom, the nitric acid will begin digesting the inner surface of the projectile, thereby removing all traces of hazardous chemicals therefrom. Therefore, it may not be required to take the process of the present invention to complete digestion of the casing-breaching the casing and cleansing the interior may be sufficient to render the munition both inoperative and environmentally benign.

Of course, when practiced on a large scale, the method of the present invention will require a distribution system to store and supply the corrosive fluid to the reaction vessel, as well as a ventilation system to handle off-gases. For example, Applicants have observed that the dissolution of steel casings in nitric acid will release $NO_x$ and hydrogen as off-gas. Acid recovery apparatus will recover any acid entrained in the off-gas stream.

In the event the container to be dissolved has been coated with protective coatings, or painted, Applicants have observed that the digestion rate of the present process is greatly enhanced if the coating or paint is at least partially removed. The removal of only a small portion of the coating will permit more rapid point dissolution at that location, and once the casing is breached, the dissolution liquid enters the casing and begins digesting the casing from the inside.

Treatment of test rounds may proceed in the same manner as treatment of rounds containing actual chemical agents. Test rounds are generally filled with an ethylene glycol fluid to simulate the physical characteristics of chemical agents. When immersed in, or treated with, nitric acid, upon breaching the shell casing, the reaction of the nitric acid and the ethylene glycol to form oxalic acid is as follows:

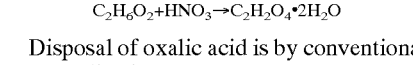

$$C_2H_6O_2+HNO_3 \rightarrow C_2H_2O_4 \cdot 2H_2O$$

Disposal of oxalic acid is by conventional means, such as by neutralization.

EXAMPLE 1

As set forth in Table 1 below, based upon the data from coupon tests, a number of calculations were made using the process of the present invention. Three representative samples are set forth illustrating the effect of temperature, nitric acid concentration, and exposure time on the corrosion rate of A-516 grade 55 mild steel rectangular coupons.

TABLE 1

| TEST # | TEMP (° C.) | $HNO_3$ Conc. | Time (h) | Beg. Wt. (g) | Final Wt. | Wt. Chg. | Corr. (in/D) |
|---|---|---|---|---|---|---|---|
| 6 | 30 | 6M | 1.09 | 10.05 | 2.01 | 8.04 | 0.9 |
| 28 | 40 | 7M | 0.3 | 9.41 | 1.88 | 7.53 | 3.2 |
| 18 | 50 | 8M | 0.14 | 9.16 | 1.83 | 7.33 | 6.7 |

As is apparent from the calculations of Table 1, the process of the present invention is capable of corroding through greater than 6 inches of carbon steel per day, indicating that a shell having a ½" thick casing can be dissolved in less than two hours.

The scope of the present invention is not to be limited to the particular embodiments described in detail above, nor is the invention limited to any particular number or sequence of steps or structural details. Therefore, in the practice of the invention, numerous changes and modifications in the process may be made without departing from the spirit or scope of the invention. Accordingly the scope of the invention is to be determined solely by the scope of the claims appended hereto.

We claim:

1. A method of treatment and disposal of a munition having a metallic casing, and an explosive trigger, and which contains a chemical agent for dispersal upon detonation, comprising the steps of:

a. digesting at least a portion of the metallic casing in a concentrated nitric acid solution in a reaction vessel without electrochemical dissolution;

b. exposing the chemical agent to the nitric acid solution to neutralize the chemical agent to a benign condition;

c. producing a liquor containing the spent acid, the dissolved metallic casing and the neutralized chemical agent; and d. disposing of the liquor.

2. The method of claim 1, further comprising the step of treating the liquor by heating the liquor to a temperature of up to about 50° C.

3. The method of claim 1, further comprising the step of filtering out of the liquor undissolved constituents of the munition.

4. The method of claim 1, further comprising the step of introducing an effective quantity of oxygen into the reaction vessel in order to enhance dissolution of the metallic casing.

5. The method of claim 1, further comprising the step of removing at least a portion of protective coatings on the outer surface of the casing prior to dissolution.

6. The method as recited in claim 1, further comprising the step of disassembling a portion of the munition to remove the explosive trigger therefrom while leaving the chemical agent relatively undisturbed.

7. A method of dissolving containers used for the storage, and/or transport of hazardous chemicals, comprising the steps of:

a. immersing the container in a concentrated acid;

b. causing the concentrated acid to flow over an outer surface of the container;

c. subjecting the container to the concentrated acid without electrochemical dissolution for a period of time sufficient for the concentrated acid to breach the container such that concentrated acid flows into an inside of the container; and d. permitting the concentrated acid to flow into the container such that the concentrated acid cleanses inner surfaces of the container in contact with the hazardous material.

8. The method as recited in claim 7, further comprising the step of removing a protective coating on the outer surface of the container.

9. A method of disposing of a steel test munition having a quantity of ethylene glycol therein, comprising the steps of:

a. immersing the test munition in a quantity of nitric acid;

b. subjecting the test munition to the nitric acid for a period of time at least sufficient for the nitric acid to dissolve a portion of the steel casing of the test munition, such that nitric acid flows into an inside of the casing;

c. permitting the nitric acid to flow into an inside of the casing such that nitric acid intermixes with and interacts with the quantity of ethylene glycol therein;

d. converting the ethylene glycol within said casing to oxalic acid, and producing a liquor containing the nitric acid, the oxalic acid, and reaction products of the dissolution of the steel casing; and e. disposing of the liquor and any undissolved steel casing.

* * * * *